US007527540B2

(12) United States Patent
Melius

(10) Patent No.: US 7,527,540 B2
(45) Date of Patent: May 5, 2009

(54) RELIEF JET APERTURE SWIM FINS WITH LIVING-HINGE BLADE

(76) Inventor: John David Melius, 2725 Vista Ct., Waldorf, MD (US) 20603

( * ) Notice: Subject to any disclaimer, the term of this patent is extended or adjusted under 35 U.S.C. 154(b) by 0 days.

(21) Appl. No.: 11/979,561

(22) Filed: Nov. 6, 2007

(65) Prior Publication Data

US 2008/0108259 A1 May 8, 2008

Related U.S. Application Data

(60) Provisional application No. 60/864,459, filed on Nov. 6, 2006.

(51) Int. Cl.
*A63B 31/08* (2006.01)

(52) U.S. Cl. ..... 441/64

(58) Field of Classification Search ..... 441/64; D21/806

See application file for complete search history.

(56) References Cited

U.S. PATENT DOCUMENTS 6,375,531 B1 * 4/2002 Melius ..... 441/64
2002/0106950 A1 * 8/2002 Feng ..... 441/64

* cited by examiner

*Primary Examiner*—Ed Swinehart
(74) *Attorney, Agent, or Firm*—John Melius

(57) ABSTRACT

A fin with a hydrodynamic flex control framework allows the axis of bending to be in close proximity to the ball of the user's foot making kicking easier as well as more productively efficient and a method providing thrust from an unusually low drag kick by a swimmer are disclosed. The fin includes a fin for use by a swimmer comprising a foot pocket adapted to receive a foot of the swimmer; a foil shaped blade extending from the foot pocket; hydrodynamic flex control framework configured to allow the blade to bend in close proximity to the ball of the user's foot within a narrow range of angles of attack under a wide range of loads while enhancing hydrodynamic performance. The present invention allows low drag kicking by a swimmer that is similar to walking in place with the user's feet staying within the user's slip stream.

20 Claims, 5 Drawing Sheets

FIG. 3
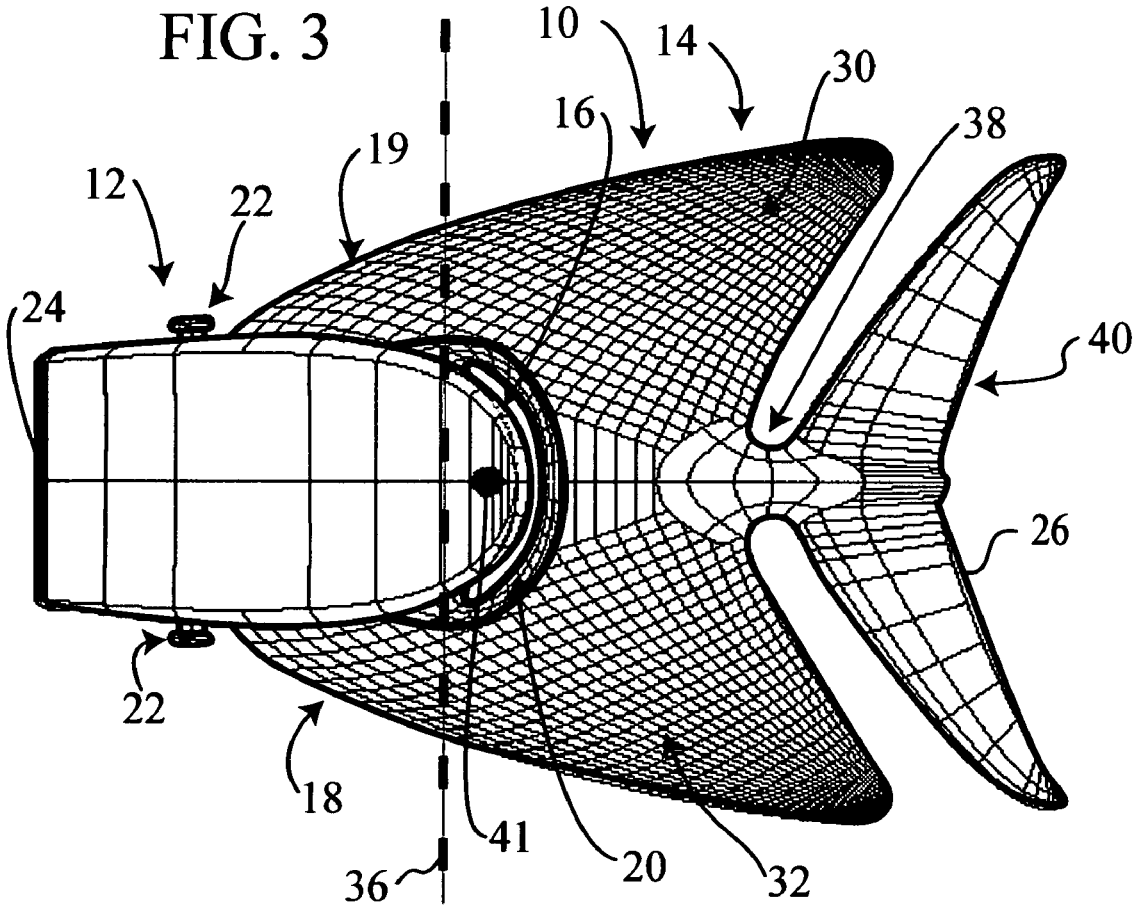
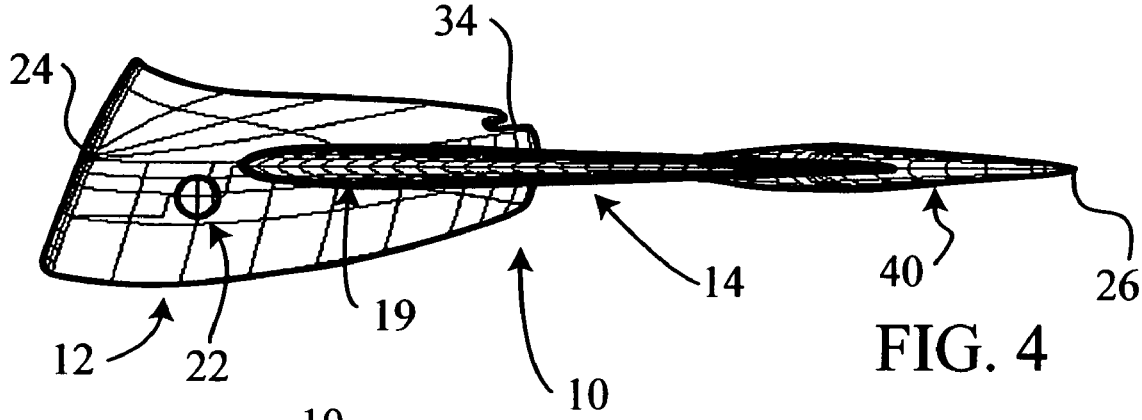
FIG. 4
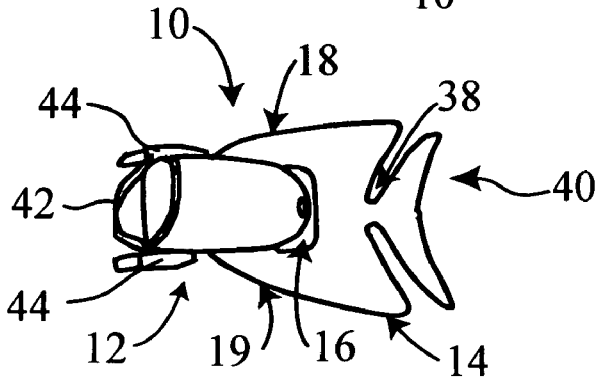
FIG. 5

PRIOR ART DRAWINGS
FIG. 8
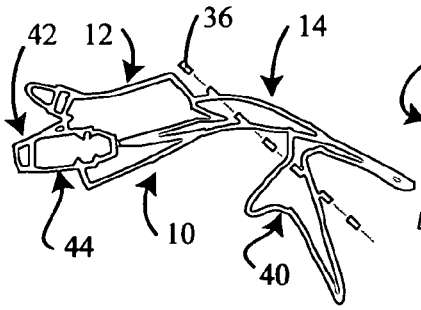
FIG. 9
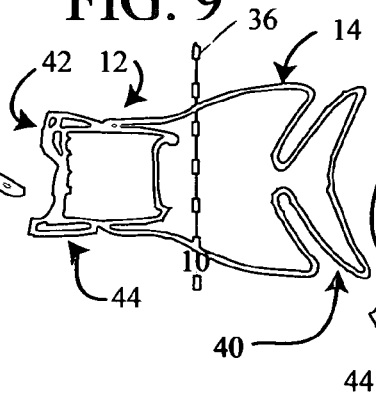
FIG. 10
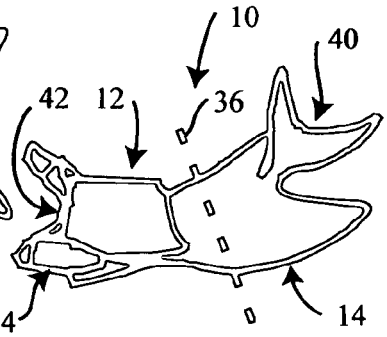
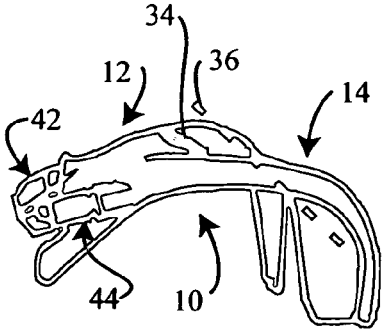
FIG. 11
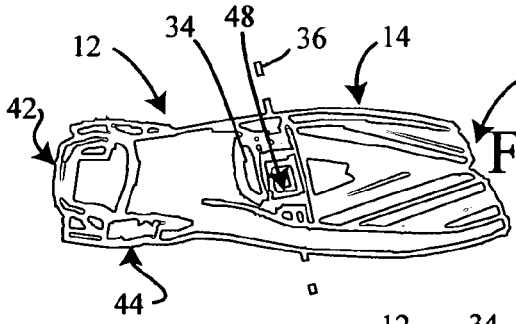
FIG. 12
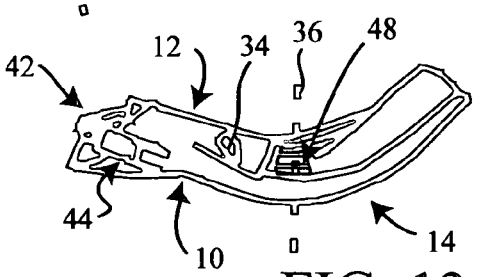
FIG. 13
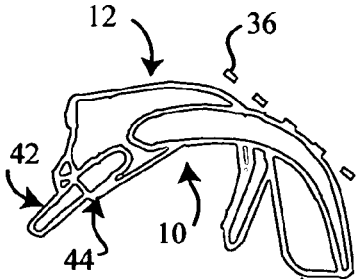
FIG. 14
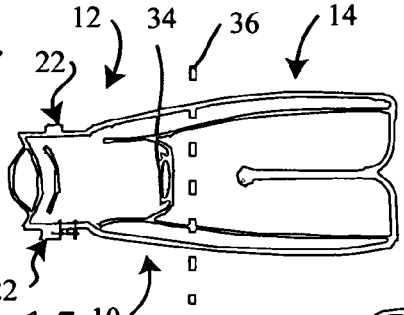
FIG. 15
FIG. 16
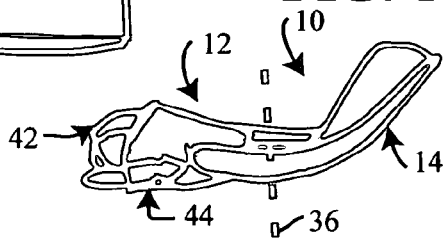

FIG. 17
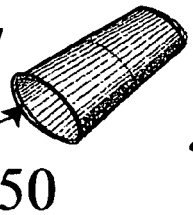
FIG. 18
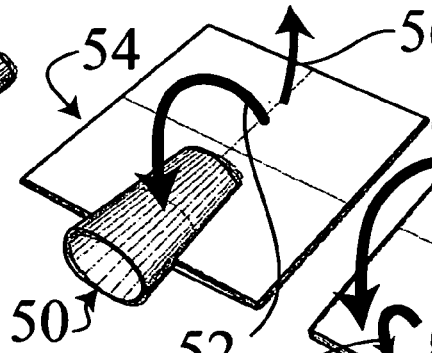
FIG. 19
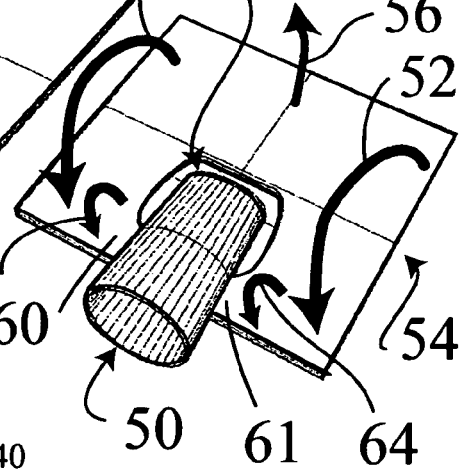
FIG. 20
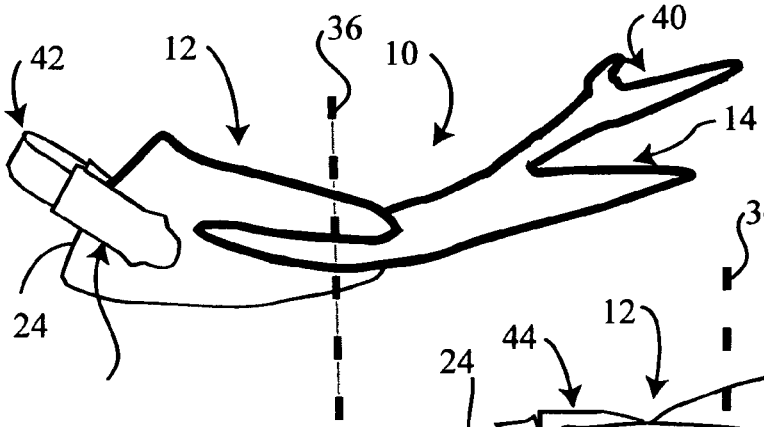
FIG. 21
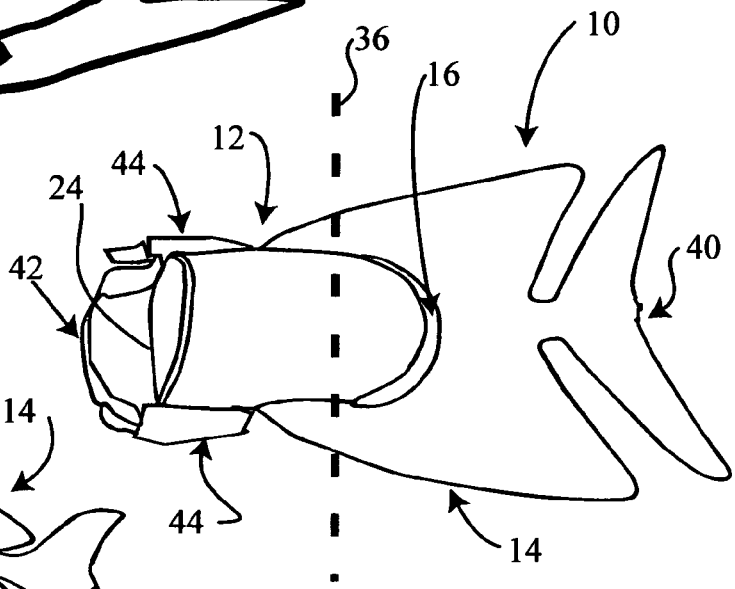
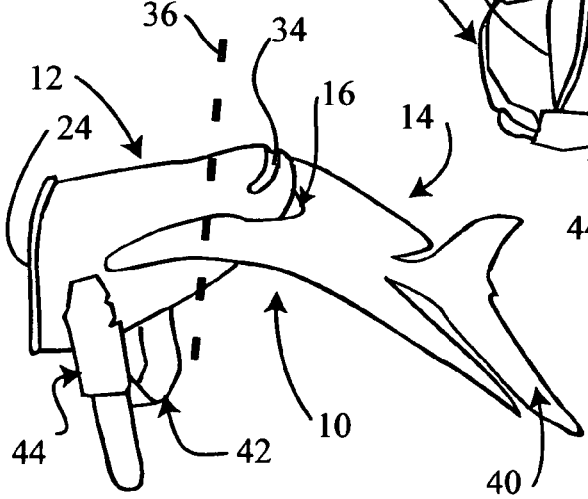
FIG. 22

RELIEF JET APERTURE SWIM FINS WITH LIVING-HINGE BLADE

CROSS REFERENCES TO RELATED APPLICATIONS

This invention draws upon provisional application No. 60/864,459 filed Nov. 6, 2006.

STATEMENT REGARDING FEDERALLY SPONSORED RESEARCH OR DEVELOPMENT

This invention is not related to a federally sponsored research or development project.

THE NAMES OF THE PARTIES TO A JOINT RESEARCH AGREEMENT

This invention is not the output of a joint research action or agreement.

REFERENCES TO APPENDICES ON A COMPACT DISC AND AN INCORPORATION-BY-REFERENCE OF THE MATERIAL ON THE COMPACT DISC

This application does not include compact discs or related files.

FIELD OF THE INVENTION

The present invention relates to a swim fin, comprising a seat for the foot, the so-called foot pocket and a propelling blade (or in an alternative embodiment a propelling blade and a propelling tail fin) with an advanced design with improved control of the location of the bending of the blade through the use of a relief jet aperture in a portion of the blade of the swim fin that surrounds and frees the closed toe section of the fot pocket from immediate contact with the blade. Various types of relief jet apertures are known but none surround the closed toe section of the foot pocket to release that section of the foot pocket from the blade thus allowing the blade to bend in close proximity to the ball of the user's foot enabling an easier bending of the blade. Beyond the hydrodynamic gains from the relief jet aperture, this aperture releases the closed toe section and the blade forms two living hinges extending from the left and right side of the foot pocket in close proximity to the ball of the user's foot thus enabling an adjustable flexibility of the blade to produce a better angle of attack and to have an axis of bending in close proximity to the ball of the user's foot.

BACKGROUND OF THE INVENTION

Swim fins are generally known and typically include a closed toe foot pocket and a blade portion. A desirable feature of a swim fin is that the blade portion of the fin easily attains a correct "angle of attack". The angle of attack is the relative angle that exists between the oncoming flow (i.e., direction of motion of the user) and the actual lengthwise alignment of the blade of the fin. A "correct angle of attack" optimizes the conversion of kicking energy of the user to thrust or propulsion through the water (and in the case of a tail fin maximizes the lift generated by the hydrofoil shape of the tail fin). When this angle is small, the blade is at a low angle of attack. When this angle is high, the blade is at a high angle of attack. As the angle of attack increases, the flow collides with the fins attacking surface at a greater angle. This increases fluid pressure against this surface for the blade (but decreases the surface pressure for the tail fin as it is creating lift). The propulsion is achieved either through drag propulsion (creating a void with the blade and being pulled into that void) or through lift (creating a lower pressure through the Bernoulli principle like an airplane wing). When using lift propulsion, the ability to increase the frequency of the sinusoidal wave created by the kicking stroke while decreasing the amplitude (the distance between the fins when they are at their farthest distance apart) to generate higher thrust with reduced drag is desirable enhancement to swim fin performance.

Current and traditional fins tend to assume different curvatures to form their attack angles according to the direction of movement and the magnitude of the forces applied during use (i.e., the amount of energy or power in the kick and the amplitude of the kicking stroke). Designing a swim fin to provide a particular angle of attack for a particular amount of power is generally known. One way to design a fin for a particular kicking power is to alter the composition of the material (e.g., stiff material for hard kicking, flexible or soft material for light kicking, etc.). Changing the composition of the material, however, does not efficiently or adequately control the angle of attack because of the unknowns manifested in compliant geometry. Most existing fins can only reach a compromise in that they are either stiff, soft, or somewhere in between. When conventional fins are designed for hard kicking (e.g., made of stiff material), they reach the correct angle of attack when kicked very hard. On a normal, relaxed kick they don't bend far enough and this negatively affects the performance. Fins of this kind will be uncomfortable on the legs, strenuous and with poor performance on a relaxed dive. When conventional fins are designed for light kicking (e.g., made of soft material or made with large vents or splits), they reach the correct angle of attack when kicked very gently. With a strong kick, such as when swimming in a current or needing to get up to speed, the blade is overpowered and there is little or no thrust available because a small void is created poorly. Fins like this might be comfortable on a relaxed dive, but could become unsafe by not being able to provide the thrust to overcome a slight current. When conventional fins are somewhere in between, they can be overpowered when kicked real hard, are still uncomfortable when kicked gently, but cover a wider range of useful kicking power.

When such known fins are used outside their prescribed kicking power, the angle of attach tends to be too low or too high. When the fin blade is at excessively high or low angles of attack, the flow begins to separate, or detach itself from the low pressure surface of the fin. This tends to cause the fin to be less efficient. Another problem that occurs at higher angles of attack is the formation of vortices along the outer side edges of the fin. This tends to cause unwanted drag. Drag becomes greater as the angle of attack is increased. This reduces the ability of the user to create a significant difference in pressure (by creating a void) between its opposing surfaces for a given angle of attack, and therefore decreases the power delivered by the fin.

Most swim fins have reinforcing ribs for the blade to help give the generally flat flexible material of the blade enough structural support so as to give an appropriate amount of flex for the blade. These ribs also serve to keep the blade from causing the closed toe foot pocket from collapsing in a crease that crushes the toes of the user as is explained in more detail later. Some blades have splits to allow the water to flow through with less resistance and some are longer and some are shorter. Some blades are foil shaped to increase the laminar flow over the surfaces, but most are simply flat planes with supporting ribs. The large majority of fins historically produced and in use at present are the closed toe embodiment of foot pockets.

In the present state of the are, the blade for of each fin starts its bending several inches in front of the toes of the foot pocket. McCarthy's U.S. Pat. No. 6,884,134 has an extensive description of the prior art as of its 2003 filing. In this overview of the art, it is clear that the closed toed foot pockets presented there, describing a broad review of the art, consistently have blades whereby the blades bend several inches in front of the toe section of the foot pocket. This increases the effort needed to use these fins in comparison to the same fin that would bend to the proper angle of attack in close proximity to the ball of the user's foot. Any work done further from the heel requires more energy because of centrifugal forces. This principle is disclosed and better explained in Melius U.S. Pat. No. 6,893,307.

Other swim fins may have vents or apertures in front of to the toe section of the foot pocket. These vents or apertures have been designed to relieve some of the water pressure on that part of the blade and possibly to enhance water flow over the blade. The vents or apertures do not free the toe section from the plane of the blade so that it can more independently from the plane of the blade. Thus, the blade works to stiffen the toe section so that it will not crease towards the toes of the user as is disclosed later in this patent. These swim fins are difficult to bend near the foot pocket because the closed toes foot pocket generally has the shape of a truncated irregular cone to help seat the foot. This truncated irregular cone shape for the foot pocket is very difficult to bend or deform even with the use of soft flexible materials because this type of geometric shell acts something like an arch. It doesn't bend evenly, but rather breaks at in a crease causing undue pressure on the toes of the user. Thus, the vast majority of swim fins are stiffened on either side of the foot pocket so that the blade will flex on an axis several inches down the blade away from the foot pocket.

It is also apparent that open toed foot pockets bend further down the blade from where the toes protrude from the foot pocket. In some open toed variations of foot pockets for swim fins such as those disclosed in Melius' U.S. Pat. Nos. 6,893,307 and 7,083,485, the blade has an axis of flexing somewhat closer to the toes as is disclosed in more detail later in this patent. In this case, the intersection of the foot pocket with the blade still needs a certain amount of increased stiffness because it can develop material failures at the open toe to blade intersection. Because the material finds an edge at this intersection, stress on this edge can start rips in the material. The swim fins found in Evans' U.S. Pat. Nos. such as 6,354,894; 5,417,599; and 4,857,024 all have blades with open toed foot pockets, but the blades are designed and functionally bend in front of the toes of the users to relieve the stresses that would otherwise rip the material at the intersection of the foot pocket and the blade. The blade open toed foot pocket interface has to be stiff to withstand the forces of flexing during normal use at that intersection, and this limits the flexibility of the blade near this intersection.

Thus, it would be advantageous to provide a swim fin that provides a desired or optimum angle of attack for a range of kicking strengths and a variety of amplitudes (the distance that the fins travel from one extreme to the other during one cycle in kicking) in the kicking stroke. It would further be desirable to provide a swim fin in which the angle of attack is accurately controlled both for the upstroke and for the down stroke so that the ratio of power to fin area is markedly increased (which makes it possible to reduce the overall size of the swim fin without sacrificing total power) for various kicking efforts. It would further be advantageous to be able to change a small portion of the fin to better be able to adjust the performance characteristics of the fin through empirical testing thus allowing the altering the mold with a relatively inexpensive insert for the mold in the manufacturing process to create a larger or smaller relief jet aperture to alter the fin for various types of kicking strengths and energies. This would be advantageous by controlling the angle of attack by controlling the structural characteristics of the bending of the blade and not by altering the characteristics of materials which would enhance the empirical control of the bending of the blade. It would further be desirable to provide a swim fin with living hinges that increase the performance by controlling the angle of attack and converting a higher percentage of the kick energy into thrust while reducing the energy needed to deform the blade into the proper angle of attack because the blade bends in close proximity to the ball of the user's foot. It would further be advantageous to provide a swim fin with flow characteristics that pull the water into the center of the blade (and tail fin when a tail fin is used) and provides improved water flow characteristics by reducing drag through the generation of side vortices. It would further be desirable to have a swim fin that increased speed and thrust with an increase in smaller kicking stoke amplitudes while increasing the frequency of the stroke. It would further be desirable to provide for a swim fin having one or more of these or other advantageous features.

To provide an inexpensive, reliable, and widely adaptable swim fin with improved angle of attack (for both non-lift-generating surfaces and lift-generating surfaces such as foil shaped blades and tail fins), improved efficiency with the relief jet aperture aperture allowing the blade to bend in close proximity to the ball of the user's foot, improved methods for swimming with lower drag kicking techniques representing a significant advance in the art.

SUMMARY OF THE INVENTION

The present invention relates to a swim fin for use by a user. The fin comprises a foot pocket with a toe section adapted to receive a foot of the user, a foil shaped blade extending from the foot pocket, and a hydrodynamic flex control framework 21 with at least one relief jet aperture and with two living hinges allowing the blade to bend in close proximity to the ball of the user's foot within a narrow range of angles of attack under a wide range of loads.

The present invention also relates to a swim fin for use by a user. The fin comprises a closed toe foot pocket adapted to receive a foot of the user, a blade extending from the foot pocket, and a hydrodynamic flex control framework 21 configured to allow the blade to bend in close proximity to the ball of the user's foot within a narrow range of angles of attack requiring less effort under a wide range of loads.

The present invention further relates to a swim fin for use by a swimmer. The fin comprises a foot pocket adapted to receive a foot of the swimmer, a blade extending from the foot pocket, and a means for releasing the toe section of the foot pocket from the blade allowing the blade to have a controlled bend in close proximity to the ball of the user's foot.

The present invention further relates to a method of providing thrust from a kick by a user. The method comprises providing a swim fin comprising a foot pocket, a blade, and one or more relief jet apertures that generally surround the toe section of the foot pocket, and one living hinge on the left side and one living hinge on the right side of the blade intersecting the foot pocket. The method also comprises bending the blade relative to the foot pocket about an axis that is in close proximity to the ball of the user's foot and controlling the bending of the blade by providing increased resistance by the living hinges as the kicking power increases while the user keeps the user's kicking in line with the user's body user's body thus reducing drag. This kicking is unusually small compared to traditional kicking with the user needing only to move the user's knees and feet as much as is needed for walking. In effect, the user kicks as if he were "walking-in-place" and this smaller kicking reduces drag dramatically.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Therefore, the present invention has the purpose to improve the controlled bending of the blade to a location in close proximity to the ball of the user's foot, by the use of a jet relief aperture and living hinges incorporated into the blade, a fin such as the one described hereinbefore, to better achieve a consistently successful angle of attack for the blade with less effort under a wider use of energetic kicking strokes while releasing the closed toe section of the foot pocket.

DESCRIPTION OF THE FIGURES

FIG. 3 is a bottom plan view of the fin of FIG. 2. (Introducing part: 41 alternate water drain.)

FIG. 4 is a side elevation view of the fin of FIG. 2.

FIG. 5 is a top perspective view of the fin of FIG. 2 with enlarged relief jet aperture and buckles and a strap as an exemplary alternative embodiment. (Introducing parts: 42 strap; 44 buckle.)

FIG. 8 is a side perspective view of a prior art fin with an open toed foot pocket in a downward flexed position as an example of prior art axis of bending.

FIG. 9 is a top perspective view of the prior fin of FIG. 8.

FIG. 10 is a side perspective view of the prior art fin of FIG. 8 in an upward flexed position.

FIG. 11 is a side perspective view of a prior art fin with a water drain and relief vents in a downward flexed position.

FIG. 12 is a top perspective view of the prior art fin of FIG. 11. (Introducing part: 48 relief vent.)

FIG. 13 is a side perspective view of the prior art fin of FIG. 11 in a upward flexed position.

FIG. 14 is a side perspective view of a prior art fin with a water drain composed of Shore A 65 rubber with the blade flexed downward.

FIG. 15 is a top perspective view of prior art the fin of FIG. 14.

FIG. 16 is a side perspective of the prior art fin of FIG. 14 with the blade flexed upward.

FIG. 17 is top perspective view illustrating an irregular truncated cone. (Introducing part: 50 irregular truncated cone.)

FIG. 18 is a top perspective view illustrating the irregular truncated cone of FIG. 17 with an intersecting plane. (Introducing part: 52 blade rotation force; 54 plane; 56 water pressure force).

FIG. 19 is a top perspective view illustrating the irregular truncated cone of FIG. 17 with an intersecting plane with an aperture cut in it to free the smaller end of the cone. (Introducing part: 58 aperture; 60 right living hinge; 61 left living hinge; 62 right living hinge rotation force; 64 left living hinge rotation force).

FIG. 20 is side perspective view of the fin of FIG. 2 with the blade and blade and tail fin flexed upwards at the axis of bending in close proximity to the ball of the user's foot with a strap and buckles.

FIG. 21 is a top perspective view of the fin of FIG. 20 showing the axis of bending for the blade in close proximity to the ball of the user's foot.

FIG. 22 is a side perspective view of the fin of FIG. 20 with the blade and tail fin flexed downwards.

Figure 1:
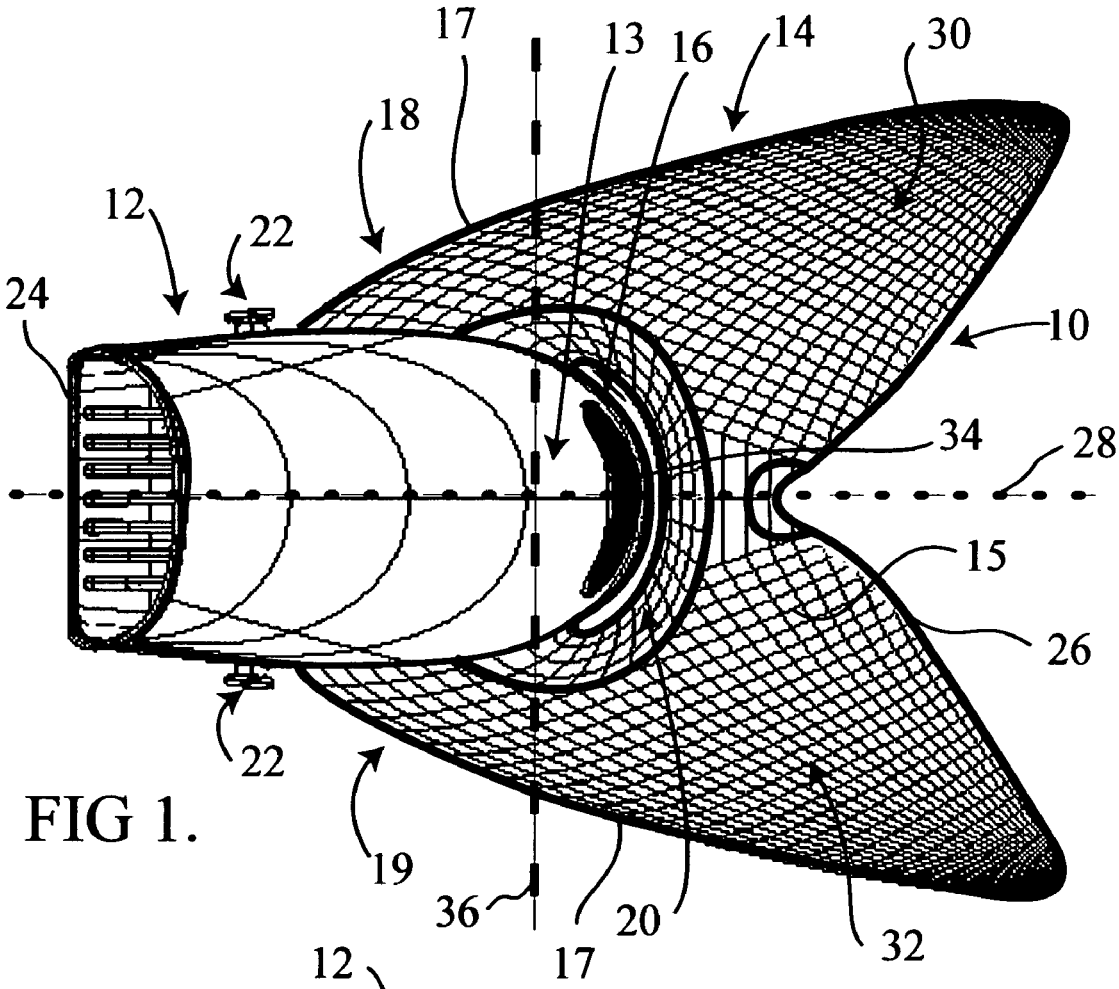
FIG. 1 is top plan view of a swim fin according to a preferred embodiment. (Introducing parts: 10 fin; 12 foot pocket; 13 toe section; 14 blade; 15 interior CAD contour lines; 16 relief jet aperture; 17 leading edge; 18 left-side living hinge; 19 right-side living hinge; 20 relief jet aperture bevel; 22 buckle boss; 24 first end; 26 second end; 28 center line; 30 left side; 32 right side; 34 water drain; 36 axis of bending.)

Before explaining a number of preferred, exemplary, and alternative embodiments of the invention in detail, it is to be understood that the invention is not limited to the details of construction and arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Referring to FIG. 1, a fin 10 is shown according to a preferred embodiment. Each fin 10 comprises a foot pocket 12, a blade 14 with a relief jet aperture 16, a left side living hinge 18, and a right side living hinge 19 that are configured by the presence of the relief jet aperture 16 to move the axis of bending 36 of the blade 14 in close proximity to the ball of the user's foot in a desired angle of attack for a variety or range of kicking strengths or powers.

According to a preferred embodiment, foot pocket 12 and blade 14 are integrally molded (e.g., in a single molding operation for improved economics and as well as excellent performance). Alternatively, foot pocket 12 and blade 14 are fused together to form an integral structure. Foot pocket 12 is shown with an open heel and buckle boss 22 for attachment of a conventional set of buckles and heel straps (shown in FIG. 8). Alternatively, foot pocket 12 includes a closed heel instead or any of a variety of conventional designs. Foot pocket 12 is preferably formed of the same material as blade 14 for improved economics as well as great performance. Alternatively, foot pocket 12 is formed of a material having a different stiffness than blade 14. For example, if the preferred material for blade 14 is stiff, the material for foot pocket 12 may be softer for increased comfort of the diver.

Blade 14 comprises a hydrodynamic flex control framework 21. The framework is configured to provide stiffness to blade 14 and channel water flow to create operational lift through a proper laminar flow directing the flow of water towards the centerline 28 of the fin 10 to reduce side vortices and unwanted drag. The framework includes a plurality of segments shown in the FIGURES as a relief jet aperture 16, a left side living hinge 18, a right side living hinge, a left side living hinge 18 and a relief jet bevel 20. The relief jet aperture 16 formed as to disconnect the toe section 13 of the foot pocket 12 from the blade 14 allowing the toe section 13 to move independently of the blade 14 and thus allowing the blade 14 to bend in close proximity to the ball of the user's foot. This axis of bending 36 flexes closer to the first end 24 of the fin 10 than the toe section 13 of the foot pocket 12. The relief jet bevel 20 improves the hydrodynamics of the flow of water over the blade 14 and while affecting the stiffness of the blade 14. The size and shape of the left side living hinge 18 and the right side living hinge 19 have multiple functions in this preferred embodiment. The living hinges 18 and 19 comprise the first part of the leading edge 17 of the foil shaped blade 14 providing a minimal disruption to the laminar flow of the fin 10 while also generating resistance to the wide range of loads from blade 14 due to their tapered shape as part of the foil shape of blade 14 generating an axis of bending 36 at the interface of the foil shaped blade 14 in close proximity to the ball of the user's foot, the living hinges 18 and 19 and the foot pocket 12. The living hinges store energy and covert the stored energy into thrust. The blade 14 can alternatively be formed by an embodiment more traditionally found in art with a flat blade and ribs, but the flat blade and ribs embodiment is a less efficient hydrodynamic embodiment (not shown). The foil shape of the blade 14 can be better recognized through the interior CAD contour lines 15 which are shown as a grid of lines where the lines intersecting the leading edge describe the flow of water from the leading edge 17 towards the second end 26 of the fin 10. The interior CAD contour lines 15 running approximately parallel to the leading edge 17 show changes in the height of the blade 14 in a manner similar to the lines of a topography map. In this preferred embodiment, the top edge of the relief jet bevel 20 intersects the foot pocket 12. The leading edge 17 of the foil shaped blade 14 slants rearwardly towards the centerline 28 of the fin 10 smoothly dividing the outflowing water towards the centerline 28 of fin 10 to reduce side vortices and therefore reduce unwanted drag.

Whereas, a conventional fin design allows for a progressive and relatively consistent bending of the entire blade at a point located beyond the user's toes on the blade to somewhat accommodate a wider range of kicking powers, a preferred embodiment of the present invention focuses the bending action around the left side living hinge 18 and the right side living hinge 19 in close proximity to the ball of the user's foot. These hinges increase in size and therefore increase in resistance as more of the mass of the hinges is leveraged. The result is that the rest of the blade 14 remains substantially straight in its structure (seen later in FIG. 11 and FIG. 12) maintaining a more constant angle of attack across a wider range of kicking powers. The tapering form of a foil as is found in blade 14 in the particularly preferred embodiment and enhances the laminar flow found in light fluids when they pass over foil shapes which generates useful lift for propelling the user.

According to a preferred embodiment, blade 14 is relatively rigid or stiff so that the flexing substantially occurs about an axis of bending 36 in close proximity to the ball of the user's foot so as to reduce the effort needed to flex the blade 14. This is true whether the blade 14 is a foil shape blade as seen in this preferred embodiment, or is a flat blade with ribs as is traditionally used. As such, blade 14 remains essentially flat during use and provides a regular planar surface to interact with the water flow to form a proper laminar flow of the water to generate much desired lift. Preferably, the foil shape of the blade 14 slants down towards the second end 26 of the fin and the center line 28 to direct the flow of water towards the center of the fin 10 to help channel the water in a desired direction and to reduce unwanted side vortices. The increased efficiency derived from the use of a rigid fin and from the use of an axis, of bending 36 located in close proximity to the ball of the user's foot, permits the design of a more powerful fin that requires less energy to use and is more efficient due to its superior axis of bending 36 and its use of lift through excellent laminar flow that allows this fin to be relatively shorter and use less material in manufacturing.

According to a preferred embodiment, relief jet aperture 16 is configured to provide a release of the toe section 13 of the foot pocket 12 to allow the living hinges 18 and 19 to provide an optimum angle of attack for a variety or range of kicking powers at the axis of bending 36. By controlling the angle of attack, the living hinges 18 and 19 are configured to increase performance and efficiency of fin 10 by converting a higher percentage of the kick energy into thrust, and doing this with less eneergy because the blade 14 bends closer to the user's ankle in close proximity to the ball of the user's foot. Additionally, the living hinges offer a means of allowing the flexing of the blade in close proximity to the bal of the user's foot as well as the means to store energy and convert the stored energy into thrust. Because the living hinges 18 and 19 permit the optimum angle of attack for foil shaped blade 14, foil shaped blade 14 provides thrust through superior laminar flow generating lift. Since this "sailing" effect is not dependent on creating a void to function as is the case in traditional paddle like blades, the frequency and the amplitude of the stroke can be dramatically reduced which also reduces drag overall for the user.

According to an exemplary embodiment, the living hinges 18 and 19 gradually increase the resistance to flexing or bending of fin 10 as a function of the amount of bending. This allows easy kicking power to flex the blade 14, but doesn't allow harder kicking power to over power the blade 14 because the lower pressure created by laminar flow over blade 14 helps to keep it at the correct angle of attack. This is true with substantially harder kicking power than might be expected because the harder the kick, the faster the laminar flow of the water which lowers the pressure. The difference between a soft kick and a hard kick is the amount of effort provided by the user and the energy transferred from the leg to the fin and from there to the water. The living hinges 18 and 19 bend the fin 10 within a narrow range of angles of attack under a wide range of loads. As such, the angle of attack is configured to not significantly vary under differing load conditions. Such control of the angle of attack also provides for the concentration and storage of the difference in energy between a soft and a hard kick in the living hinges 18 and 19 of the fin 10. These particular sections will a first accumulate the excess energy and later on release it and transfer it to the water for a high efficiency forward thrust. Because this preferred embodiment allows for a higher frequency and lower amplitude kicking sequence, the return of this stored energy is increased over any given swimming distance. More flexes offering more returns in any given distance traveled increase efficiency and recovery of invested power by the user. This energy accumulation is achieved with a small change in the degree of the bending of the blade 14 so when fin 10 is kicked gently and more frequently in smaller amplitudes, it approaches the optimal angle of attack, and when kicked harder, the angle of attack is increased only slightly (but remains near the optimum angle of attack) as the living hinges 18 and 19 absorbs and/or stores the additional energy.

According to a preferred embodiment, the living hinges 18 and 19 are made of an elastic material such that the more it stretches the more resistance it will give. Additionally, living hinges 18 and 19 have tapering shapes as part of blade 14 which preferably has a tapered shape of a foil. This tapered shape of living hinges 18 and 19 flexes more easily in the thinner parts of living hinges 18 and 19 while increasing resistance as more kicking power is applied to fin 10. As such, the more blade 14 of fin 10 wants to bend, the higher the resistance given by living hinges 18 and 19. The living hinges 18 and 19 are configured to allow fin 10 to efficiently attain an optimum angle of attack initially with minimal effort because they bend in close proximity to the ball of the user's foot. (More clarification of this effect will be discussed later).

One source of energy loss in kicking fin 10 comes from the amount of water that is being pushed back by blade 14, and "spills over" the sides of blade 14. Such "spillover" is typically caused by high pressure fluid on one side of blade 14 spilling over the side of blade 14 to the low pressure side. The difference in pressure is multiplied by the cross-sectional area of blade 14, and provides a measure for the size of the hole that the blade will make in the water to create "drag" propulsion. As such, the spillover reduces the amount of thrust generated by fin 10 because the spillover is sucked into the void created by the fin instead of the fin 10 being pulled into the void as propulsive force. According to a preferred embodiment, spillover is dramatically reduced because the foil shaped blade 14 pulls water towards the centerline 28 of fin 10 thus effectively eliminating spillover, improving hydrodynamics, reducing turbulence and increasing laminar flow.

Also, foil shaped blade 14 eliminates the need of protruding ribs through the use of the living hinges 18 and 19. The foil shape of blade 14 naturally creates living hinges 18 and 19 that have desirable characteristics that enable said hinges to bend easily in the thinner parts of blade 14 and increase in resistance as living hinges 18 and 19 get thicker due to the increase in the thickness of the foil shape of blade 14. This enables a wider range of kicking power to be used while maintaining an optimum angle of attack for blade 14. The lower pressure created over a foil shape also helps to keep the blade from bending to far at the axis of bending 36 because the blade 14 is being pulled towards the lower pressure produced by laminar flow over said foil shape. This reduces drag, reduces turbulence, reduces spillover while improving water flow and increasing laminar flow.

Figure 2:
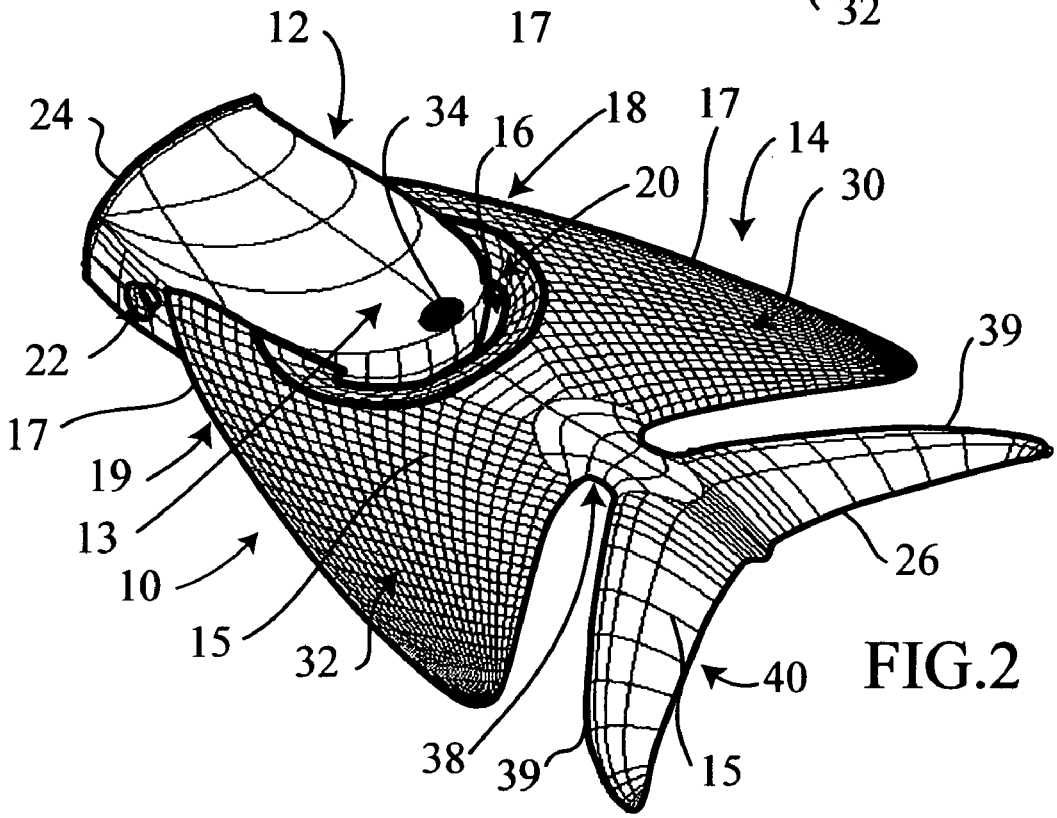
FIG. 2 is a top perspective view of the fin of FIG. 1 with a tail fin as an exemplary alternative embodiment. (Introducing parts: 38 peduncle; 39 leading edge; 40 tail fin.)

Referring to FIG. 1 in a preferred embodiment of fin 10, FIG. 2 shows a performance enhancing exemplary alternative embodiment of fin 10 that may be considered economically less desirable because of substantial increases in mold costs and increase in the costs due to the extra material used, and the increased costs associated with the manufacturing difficulties caused by the undulating size of the peduncle 39 and tail fin 40 due to the extension of the size of the fin 10 to a larger area. However, a peduncle 39 and a tail fin 40 are configured to increase speed and thrust while decreasing the effort of the user through the use of the serial amplification of the flow of water over the foil shaped blade 14 past the tail fin 40. This occurs because of the addition of another foil shape which acts in a manner similar to adding another sail (a second foil shape) to a ship. Since both foils, blade 14 and tail fin 40, induce laminar flow to create lift, they can work in tandem to create serial amplification where the flow of water across the blade is increased and then crosses to the tail fin 40 for an additional increase in speed the. This phenomenon in described more in depth in Melius U.S. Pat. No. 7,083,485.

In FIG. 3, a secondary drain hole 41 is taught having the advantage of draining the foot pocket more efficiently when used in conjunction with the preferred embodiment for water drain 34. Releasing the pressure of the water in the foot pocket 12 is advantageous after diving when the diver wants to remove his boot from the foot pocket 12. If the drain hole 41 is not provided or if the larger water drain 34 is not provided, then the diver may have serious difficulty with the boot being kept in the foot pocket 12 by a suction caused by the water present in the foot pocket 12. This is not so much a problem out of the water, but taking your boots off in the water can be unusually difficult with only the drain hole 41 at the very minimum.

FIG. 4 teaches the foil shape of blade 14 and tail fin 40 by the side view revealing their contours. This information in addition to the information taught in FIGS. 1, 2, and 3 with the interior CAD contour lines 15 help to define the nature of the foil shapes of blade 14 and tail fin 40.

As the size and shape of the relief jet aperture is changed as seen in FIG. 5, the performance characteristics of fin 10 are also changed rather dramatically because the physical size and shape of the living hinges 18 and 19 also change. This change also affects the position of the axis of bending 36. The use of no relief jet bevel 20 is taught in this exemplary alternative embodiment where the size of the relief jet aperture allows even easier deformation of blade 14 through the use of smaller living hinges 18 and 19 allowing fin 10 to be used for medicinal purposes of physical therapy for those who need to stress their leg muscles without stress their joints. This can be accomplished by having the patient float weightlessly in water and have them move their legs in various sets of exercises as controlled by a physical therapist in order to strengthen different sets of leg muscles without having the legs of the patient subjected to the stresses of gravity on their joints. In tests, the increased flow of the water through larger relief jet aperture 16 allowed the patient to move their leg with almost no extra drag. Secondly, a smaller relief jet aperture 16 could be used for those with good legs enabling more serious thrust and better propulsion while the larger sized relief jet aperture 16 could be used for someone having the medical difficulty. In patients with dramatically reduced movement (due to stroke or brain tumors for example) in one leg, the movement of the healthy leg causes the weaker disabled leg to move because of water resistance. This movement of the weaker leg feels natural to the patient and is beneficial to the patient.

Figure 6:
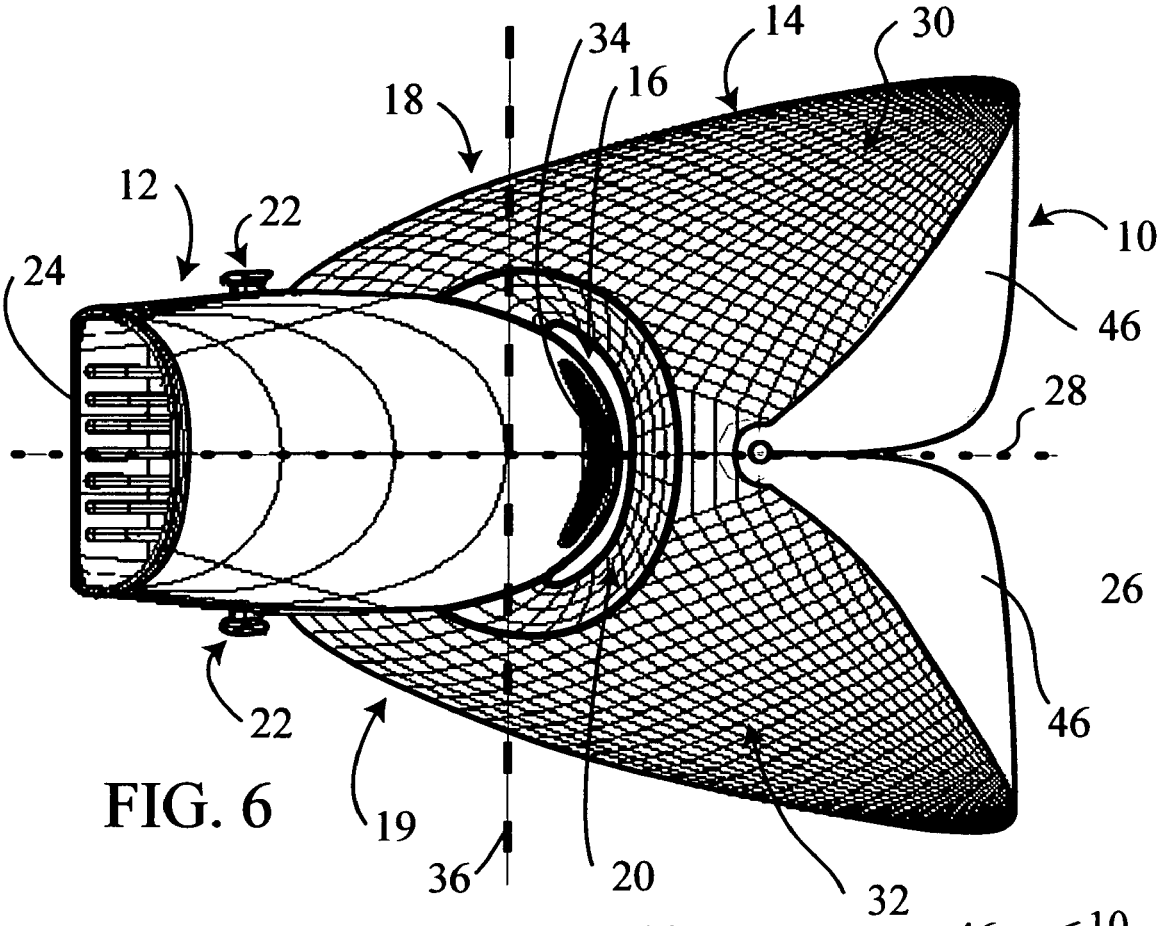
FIG. 6 is a top plan view of the fin of FIG. 1 with flexible flaps as an exemplary alternative embodiment. (Introducing part: 46 flexible flap.)

Referring to FIG. 1 in a basic preferred embodiment of fin 10, FIG. 6 shows an exemplary alternative embodiment of fin 10 where a flexible flap 46 is added on to blade 14 on either side of the centerline 28. The addition of flexible flaps 46 on the foil shaped blade 14 to enable the use of stiffer less expensive materials for blade 14 creating a positive laminar flow of water across blade 14 where the living hinges 18 and 19 would be made of a more flexible material. Blade 14 would have advantage of longer surfaces for influencing the flow of water for generating thrust without making it necessary to increase the cross section of blade 14. This formation is often found in marine mammals and allows blade 14 to be used almost in a hybrid function part as paddle and part as foil.

Figure 7:
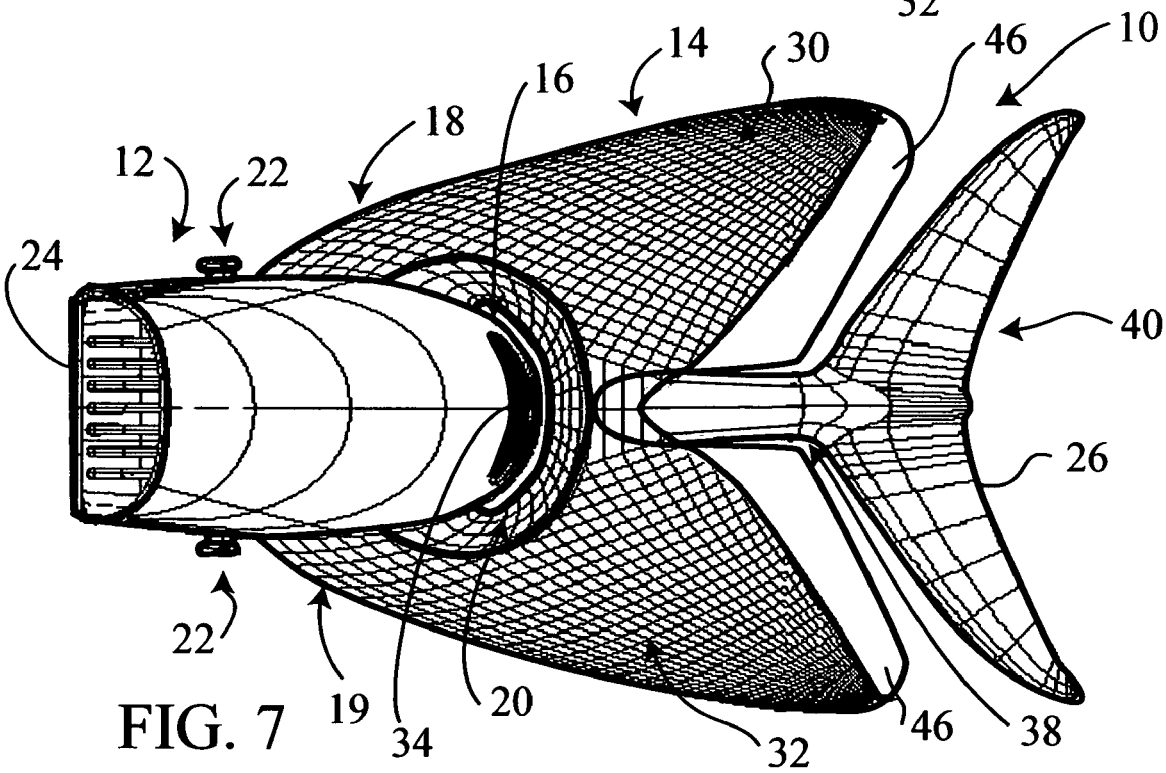
FIG. 7 is a top plan view of FIG. 2 with peduncle, tail fin and flexible flaps as an exemplary alternative embodiment.

Referring to FIG. 1 in a basic preferred embodiment of fin 10, FIG. 7 shows an exemplary alternative embodiment of fin 10 that may be considered a combination of exemplary embodiments found in FIGS. 2 and 6. This hybrid formation of hydrodynamic elements comprising flexible flaps, a peduncle and a tail fin enhance the laminar flow of water across the blade and the tail fin for increased control and propulsion.

FIGS. 8 through 16 show prior art in static and bent positions. In all embodiments in the FIGS. 8 through 16, axis of bending 36 is located in front of the usrs toes on the blade 14. This increases the effort needed to flex the blade 14 because centrifugal forces are increased as axis of bending 36 is moved further from the pivot point of the user (in this case the ankle of the user.) Since the productive work for blade 14 begins where the angle of attack is optimum, it is optimum to move the angle of attack as close to the pivot point of the ankle as is practically possible. In the present preferred and alternative embodiments, we have balanced the needs of strength, durability with the possibility that the user will hit the fins together causing discomfort and other problems for the user. Secondly, the choice of having axis of bending 36 located in close proximity to the ball of the user's foot is a natural choice. The foot of the user bends at the ball of the foot which makes that a natural choice to have axis of bending 36 of the fin 10.

FIGS. 17 through 19 teach the advantages of the hydrodynamic flex control framework 21 of the present invention. In FIG. 17, the irregular truncated cone 50 illustrates the general shape of the foot pocket 12 because the foot pocket 12 must seat the foot of the user which is an irregular truncated cone shape even when wearing a bootie. This irregular truncated cone 50 does not want to bend because it is continually under compression as all cones are when under stress from the outside of the cone. The cone will "break" (form a crease along a weak area) instead of gently spread any pressure applied to its surface. This break or collapse causes undue stress on any part of the user's foot that it presses against. In FIG. 18, the plane 54 intersects the irregular truncated cone 50 making the irregular truncated cone even stiffer because of the reinforcement that the plane 54 gives to the walls of the irregular truncated cone 50. Therefore, when the water pressure force 56 moves the plane 54 towards the irregular truncated cone 50, a blade rotation force 52 tries to compress the irregular truncated cone 50 resulting in a break or collapse in the wall causing discomfort and pain to the user. The traditional solution found on all other fins in the art that have closed foot pocket 12 is to have the axis of bending 36 located in front of pocket 12 sufficiently far as not to make the irregular truncated cone 50 collapse or break. The blade compression force 52 initiates in the plane 54 in front of the irregular truncated cone 50 and exerts pressure onto the sides of irregular truncated cone 50. In FIG. 19, the aperture 58 separates the plane 54 from the smaller end of irregular truncated cone 50 creating the right and left living hinges 60 and 61 respectively. This dramatically changes the interaction of plane 54 with the irregular truncated cone 50 because the blade rotation force 52 still initiates in front of the truncated cone 50 but transfers its force to the area located in the side of the irregular truncated cone 50 at the left and right living hinges 60 and 61. This causes right and left living hinges 60 and 61 respectively to experience a right and left living hinge rotation force 62 and 64 respectively. These forces do not try to collapse or break the irregular truncated cone 50 because they work to rotate the right and left side of the irregular truncated cone instead of trying to compress the walls of the irregular truncated cone 50. This process does not translate into pressure that the foot of the diver can experience. Additionally advantageous is the movement of the axis of bending back to the respective insertion points of the living hinges 60 and 61.

FIGS. 20 through 22 teach how the axis of bending 36 is closer to first end 24 of fin 10 than the toe section 13 of foot pocket 12. The positioning of the axis of bending 36 closer to the heel of the swimmer than is found in traditional fins delivers better performance with less energy because the axis of bending 36 needs less centrifugal force for bending. FIG. 20 shows fin 10 upwardly bent with the axis of bending 36 located closer to the heel of the swimmer when in use. FIG. 21 shows the axis of bending 36 crossing through fin 10 at the living hinges 18 and 19. FIG. 22 shows fin 10 downwardly bent with the axis of bending 36 located closer to the heel of the swimmer when in use.

Furthermore, the present invention has a preferable embodiment of a swim fin 10 comprised of a foot pocket with and open heel section, a closed toe section wherein the foot pocket is sized to receive the foot of a user such that the ball of the user's foot positions itself between the closed toe section and the open heeled section of the foot pocket. Said fin 10 also has a blade 12 comprising a hydrodynamic flex control framework 21 further comprising a relief jet aperture 16, a left side living hinge 18; and a right side living hinge 19 and a blade section in which blade section, the left side living binge 18, and the right side living hinge 19 secure on opposite sides of the foot pocket between the open heel section and the closed toe section 13 of said foot pocket 12. The blade section extends forward of the closed toe section l3 to form an opposing fin configuration at the second end of the fin. The relief jet relief aperture 16 is positioned between the blade section and the outer periphery of the closed toe section 13 of the foot pocket 12 and the living hinges 18 and 19 respectively allowing the living hinges to have an axis of bending 36 in close proximity to the ball of the user's foot without interference from the closed toe section 13 of the foot pocket 12.

The swim fin 10 can have the relief jet aperture tapered to form a relief jet aperture bevel 20 to enhance and improve laminar flow through the relief jet aperture. The blade 14 of the swim fin 10 can have a leading edge 17 of a foil shaped blade 14 that slants rearwardly towards the centerline 28 of the fin 10 to smoothly draw the water flow towards the centerline 28 of the fin 10 to reduce side vortices and eddies therefore reducing unwanted drag. When the fin 10 also has an elongated water drain 34 extending through the closed toe section 13 of the foot pocket 12, the water drain 34 provides passage of the water therethrough while also allowing relief from cramping of the user's toes. In another embodiment, the fin 10 has flexible flaps 46 extending from second end of the blade 14 enabling the use of stiffer, less expensive materials for the flexible flaps 46 wherein the living hinges 18 and 19 respectively are made of a more flexible material.

In an alternative embodiment, the fin 10 can have a peduncle secured along the centerline 28 in spaced relation from the distal end of the opposing fin 10 configuration to increase speed and thrust while decreasing the effort of the user through the use of serial amplification of the flow of water over the foil shaped blade 14. Alternative embodiments can be formed by combinations of the different embodiments mentioned heretofore.

It is also important to note that the construction and arrangement of the elements of the fin with improved angle of attack and water flow characteristics as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the energy accumulations may have any of a variety of shapes or configurations. Also, blade 14 may be made of a stiff material (rather than the preferred flexible material) and still incorporate the advantages of the living hinge system. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the following claims.

What is claimed is:

1. A swim fin having a first end, a second end opposite the first end, a right side and a left side extending between the first and second ends, and a propelling blade with a hydrodynamic flex control framework, comprising:

a) a foot pocket sized to receive the foot of a user, the foot pocket with an open heel section, a closed toe section such that the ball of the user's foot is positioned between the open heel section and the closed toe section;

b) a propelling blade with a hydrodynamic flex control framework further comprising;

a. a left side living hinge and a right side living hinge secured on opposite sides of the foot pocket between the open heel section and the closed toe section in close proximity to the ball of the user's foot allowing the axis of bending for the blade to be located in close proximity to the ball of the user's foot;

b. a blade section extending from the left side living hinge and the right side living hinge, the blade section extending forward of the closed toe section to form an opposing fin configuration at the second end of the fin;

c. a relief jet aperture is positioned between the blade section and the outer periphery of the closed toe section of the foot pocket and the living hinges allowing the living hinges to have an axis of bending in close proximity to the ball of the user's foot without interference from the closed toe section of the foot pocket.

2. The swim fin of claim 1, wherein the relief jet aperture is tapered to improve laminar flow through the relief jet aperture and across the blade section.

3. The swim fin of claim 1, wherein the leading edge of the blade slants rearward towards the centerline of the fin to smoothly allow the overflowing water to flow towards the centerline of the fin to reduce side vortices and therefore reduce unwanted drag.

4. The swim fin of claim 1, wherein an alternate water drain extends through the toe section of the section of the foot pocket to provide passage of water therethrough and to lessen the pressure on the user's toes, when flexing the blade.

5. The swim fin of claim 1, wherein a flexible flap on the blade section on both sides of the centerline enable the use of stiffer, less expensive materials for the blade, creating a positive laminar flow of water across the blade, wherein the living hinges are made of a more flexible material.

6. The swim fin of claim 1, wherein a peduncle secures at the centerline of the opposing fin configuration extending to a tail fin, the peduncle extending in spaced relation from the second end of the opposing fin configuration to the centerline of the tail fin, enabling an increase in speed and thrust while decreasing the effort of the user through the use of serial amplification of the flow of water over the blade section and tail fin.

7. The swim fin of claim 6, wherein flexible flaps on the blade section enable the use of stiffer, less expensive materials for the blade, creating a positive laminar flow of water across the blade, wherein the living hinges are made of a more flexible material.

8. A swim fin having a first end, a second end opposite the first end, a right side and a left side extending between the first and second ends, and a foil shaped propelling blade with a hydrodynamic flex control framework, a peduncle with tail fin, comprising:

a) a foot pocket sized to receive the foot of a user, the foot pocket with an open heel section, a closed toe section such that the ball of the user's foot is positioned between the open heel section and the closed toe section;

b) a propelling foil shaped blade with a hydrodynamic flex control framework further comprising;

a. a left side living hinge and a right side living hinge secured on opposite sides of the foot pocket between the open heel section and the closed toe section in close proximity to the ball of the user's foot allowing the axis of bending for the blade to be located in close proximity to the ball of the user's foot;

b. A foil shaped blade section extending from the left side living hinge and the right side living hinge, the blade section extending forward of the closed toe section to form an opposing fin configuration at the second end of the fin;

c. a relief jet aperture is positioned between the blade section and the outer periphery of the closed toe section of the foot pocket and the living hinges allowing the living hinges to have an axis of bending in close proximity to the ball of the user's foot without interference from the closed toe section of the foot pocket;

c) a peduncle secured at the centerline of the opposing fin configuration extending to a tail fin, the peduncle extending in spaced relation from the second end of the opposing fin configuration to the centerline of the tail fin, enabling an increase in speed and thrust while decreasing the effort of the user through the use of serial amplification of the flow of water over the blade section and tail fin and wherein flexible flaps on the blade section enable the use of stiffer, less expensive materials for the blade, creating a positive laminar flow of water across the blade, wherein the living hinges are made of a more flexible material.

9. The swim fin of claim 8, wherein the relief jet aperture is tapered to improve laminar flow through the relief jet aperture and across the blade section.

10. The swim fin of claim 8, wherein the leading edge of the blade slants rearward towards the centerline of the fin to smoothly allow the overflowing water to flow towards the centerline of the fin to reduce side vortices and therefore reduce unwanted drag.

11. The swim fin of claim 8, wherein an alternate water drain extends through the toe section of the section of the foot pocket to provide passage of water therethrough and to lessen the pressure on the user's toes.

12. The swim fin of claim 8, wherein a flexible flap on the blade section on both sides of the centerline enable the use of stiffer, less expensive materials for the blade, creating a positive laminar flow of water across the blade, wherein the living hinges are made of a more flexible material.

13. The swim fin of claim 8, wherein the relief jet aperture is enlarged by an insert in the mold during the manufacturing of said fin allowing an easier effort to be made by the user to bend the living hinges in normal use without a substantial loss in performance.

14. A swim fin having a first end, a second end opposite the first end, a right side and a left side extending between the first and second ends, and a foil shaped propelling blade with a hydrodynamic flex control framework, a peduncle with tail fin, comprising:

d) a foot pocket sized to receive the foot of a user, the foot pocket with an open heel section, a closed toe section such that the ball of the user's foot is positioned between the open heel section and the closed toe section;

e) a propelling foil shaped blade with a hydrodynamic flex control framework further comprising;

a. a left side living hinge and a right side living hinge secured on opposite sides of the foot pocket between the open heel section and the closed toe section in close proximity to the ball of the user's foot allowing the axis of bending for the blade to be located in close proximity to the ball of the user's foot;

b. A foil shaped blade section extending from the left side living hinge and the right side living hinge, the blade section extending forward of the closed toe section to form an opposing fin configuration at the second end of the fin;

c. a relief jet aperture is positioned between the blade section and the outer periphery of the closed toe section of the foot pocket and the living hinges allowing the living hinges to have an axis of bending in close proximity to the ball of the user's foot without interference from the closed toe section of the foot pocket;

f) a flexible flap on the blade section on both sides of the centerline to enable the use of stiffer, less expensive materials for the blade, creating a positive laminar flow of water across the blade, wherein the living hinges are made of a more flexible material.

15. The swim fin of claim 14, wherein the relief jet aperture is tapered to improve laminar flow through the relief jet aperture and across the blade section.

16. The swim fin of claim 14, wherein the leading edge of the blade slants rearward towards the centerline of the fin to smoothly allow the overflowing water to flow towards the centerline of the fin to reduce side vortices and therefore reduce unwanted drag.

17. The swim fin of claim 14, wherein an alternate water drain extends through the toe section of the section of the foot pocket to provide passage of water therethrough and to lessen the pressure on the user's toes, when flexing the blade.

18. The swim fin of claim 14, wherein a peduncle secured at the centerline of the opposing fin configuration extending to a tail fin, the peduncle extending in spaced relation from the second end of the opposing fin configuration to the centerline of the tail fin, enabling an increase in speed and thrust while decreasing the effort of the user through the use of serial amplification of the flow of water over the blade section and tail fin and wherein flexible flaps on the blade section enable the use of stiffer, less expensive materials for the blade, creating a positive laminar flow of water across the blade, wherein the living hinges are made of a more flexible material.

19. The swim fin of claim 14, wherein the relief jet aperture is enlarged by an insert in the mold during the manufacturing of said fin allowing an easier effort to be made by the user to bend the living hinges in normal use without a substantial loss in performance.

20. The swim fin of claim 19, wherein the reliefjet aperture is tapered to improve laminar flow through the enlarged tapered relief jet aperture and across the blade section.

* * * * *